United States Patent [19]

Collins

[11] 4,399,986

[45] Aug. 23, 1983

[54] DEVICE FOR PLUGGING A TAPHOLE IN A FURNACE

[76] Inventor: William J. Collins, 7005 Madison St., Merrillville, Ind. 46410

[21] Appl. No.: 330,471

[22] Filed: Dec. 14, 1981

[51] Int. Cl.[3] ..... C21C 5/46

[52] U.S. Cl. ..... 266/272; 266/45

[58] Field of Search ..... 266/271, 272, 45

[56] References Cited

U.S. PATENT DOCUMENTS

| | | | |
|---|---|---|---|
| 3,540,627 | 11/1970 | Armstead | 266/272 X |
| 4,010,936 | 3/1977 | Takashima | 266/271 X |
| 4,030,709 | 6/1977 | Shepard et al. | 266/272 X |

FOREIGN PATENT DOCUMENTS

| | | | |
|---|---|---|---|
| 2549728 | 3/1977 | Fed. Rep. of Germany | 266/272 |

*Primary Examiner*—M. J. Andrews
*Assistant Examiner*—David A. Hey
*Attorney, Agent, or Firm*—Charles S. Penfold

[57] ABSTRACT

The subject invention or inventions involves providing a device which serves to substantially retard or prevent the flow of slag through a taphole of a furnace or other vessel containing molten steel, thereby improving the quality or grade of the metal. The device comprises a plug which is of such a character that when inserted in a taphole and the furnace is tilted the taphole will move to a position below the level of the layer of slag until the plug is disintegrated or destroyed by the metal to automatically allow substantially only the latter to enter and flow through the taphole or passage.

14 Claims, 7 Drawing Figures

DEVICE FOR PLUGGING A TAPHOLE IN A FURNACE

BACKGROUND OF THE INVENTION

The production of steel in Basic Oxygen furnaces as well as other vessels for producing steel normally requires a layer of purifying slag comprised of lime and other materials which act as a blanket on top of the molten steel, encouraging various impurities in the steel to take "refuge" in the slag. The similarity is comparable to cream floating to the top of milk.

As the steel reaches the proper temperature and chemistry to "tap" into a ladle for dispatch to "teeming" continuous casting or other distribution, the tilting of the furnace will allow the slag blanket or layer to reach the taphole first before the molten steel. This would allow the slag with the impurities included to reach the bottom of the ladle (or awaiting receptacle) first, followed by the molten steel which, similar to milk and cream, would then cause the slag to permeate through the increasing level of molten steel striving to reach the top of the steel where traditionally it has tended to form a thermal blanket to retain latent heat of the steel in the ladle or other container.

In response to requests to devise some way that would in effect temporarily plug the taphole long enough for the molten steel to arrive at the taphole before too great an amount of slag had exited, my invention as hereinafter described has presented a device and method of doing so.

With experience derived from protecting my Patented devices for sampling molten metal with paper sleeves, I looked first toward paper products of a generally conical shape. Papier-mache containers used in flower shops promised such a shape in a moderate cost area. By dipping these containers in high temperature refractory slurry and filling with paper dust, sawdust, wood fiber aggregate, and glue, a composite material or mass was developed that imparted a highly thermal resistant material which was capable of adhering to the interior and external surfaces of the paper containers.

To assist in insertion, the devices or plugs centered around a paper tubular shape which provided a socket for insertion of a pipe, a pole, rod or tube, which could then extend the plug to the point where it is inserted into the taphole of the furnace, similar to forcing a cork into a bottle opening. As the opening of the taphole changes dimensions, shape, and contour with the passage of each heat of steel, the taphole plug must either lend itself to conforming to the irregularity of each opening by its very resiliency; hence, the container of the plug or device is preferably only partly filled. Various major and minor diameters and degrees of conical taper may be provided to accommodate the changing dimensions and shapes of the tapholes.

As an irregular surface on the paper is apparently necessary to provide cohesion on the surface area to the refractory slurry, the papier-mache surface has proven to be ideal, but this constitutes only one of several approaches. Abrading the surface of the paper, applying absorbent paper or fabric such as cheese-cloth with mastic are other modifications or methods of providing a surface or surfaces to which a refractory will adhere.

As the result of an investigation, attention is directed to a U.S. Pat. to Imberti, No. 3,938,791, issued Feb. 17, 1976; a Japanese Pat. No. 52-32604 having an issue date of August 1977; a Russian Pat. No. 234,803 dates 1969 and another No. 673825 dated 1979.

OBJECTIVES

In view of the foregoing, a primary object of the subject invention or inventions is to improve the quality or grade of molten steel and this is accomplished by substantially retarding or preventing the escape of slag through a taphole or passage in a furnace or other vessel containing the molten steel. Otherwise expressed, the invention affords a setup whereby substantially only molten steel or metal will flow through the taphole.

More particularly, the invention involves providing a device in the form of a disintegratable plug for manual disposition in the taphole just before the furnace is tilted to begin the pouring or dispensing operation and the plug is of such a character that it will temporarily retain its shape while the taphole moves through and below the layer of slag following which the plug is automatically disintegrated by the molten steel, thereby allowing substantially only the steel to flow freely through the taphole or passage.

The device may be designed and constructed in various ways but is preferably constructed to comprise what may be termed a container which is preferably first coated with a layer of refractory material and subsequently filled with an inner mass or aggregate of composite materials, such as paper dust, sawdust, wood fiber, plaster mix, glue and water.

Another object of the invention is to provide a device as described in the preceding paragraph which is provided with means such as a socket, for detachable connection with a lance whereby to facilitate manipulation and insertion of the device into the taphole.

A specific objective is to provide a device which is preferably in the shape of what may also be termed a substantially tapered container or cylinder which preferably has some resiliency in order to promote its satisfactory engagement with variable internal cross-dimensions of tapholes.

A significant object is to provide a method which comprises inserting a disintegratable plug into the taphole of a furnace adapted to contain a mass of molten metal having a layer of slag thereon, and tilting the furnace so that the plug will first substantially retard the flow of slag into the taphole and then be automatically disintegrated by the molten metal to allow the latter to flow through the taphole.

Other objects reside in providing a device which is relatively economical to produce, due to the ready availability of the inexpensive materials utilized; readily maniputable; and relatively durable or stable until disintegrated.

Additional objects and advantages of the invention or inventions will become apparent after the description hereinafter set forth is considered in conjunction with the drawings annexed hereto.

DRAWINGS

DESCRIPTION

Figure 1:
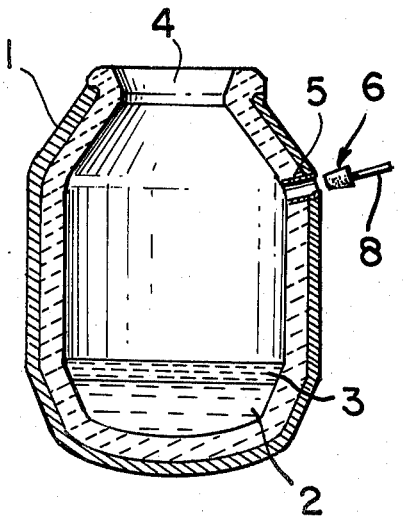
FIG. 1 is a vertical section of a furnace containing molten metal and a layer of slag thereon and a device about to be inserted into a taphole of the furnace.

Referring first to FIG. 1, there is disclosed a furnace 1 disposed in a vertical position and containing a mass of molten steel 2 with a layer of slag 3 thereon. This furnace may be designed and constructed in any manner desired and is of conventional character and provided with an upper opening 4 and a taphole or passage 5 located in its side wall above the layer of slag.

Figure 2:
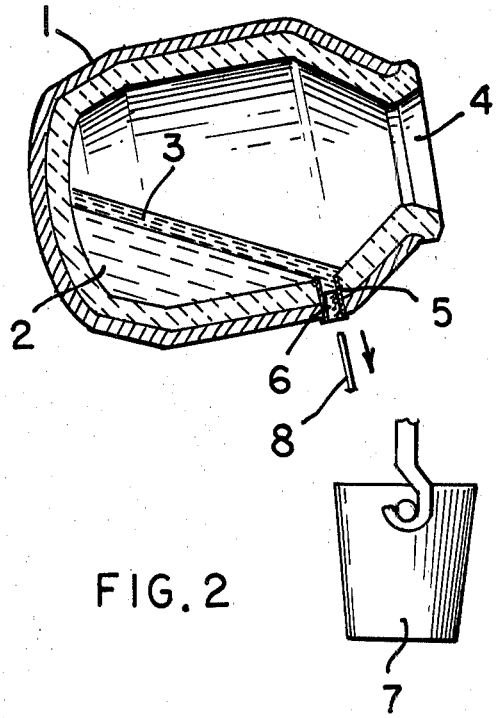
FIG. 2 is a view showing the device inserted into a taphole to substantially retard entry of the slag into the taphole when the furnace is tilted a predetermined extent.
Figure 3:
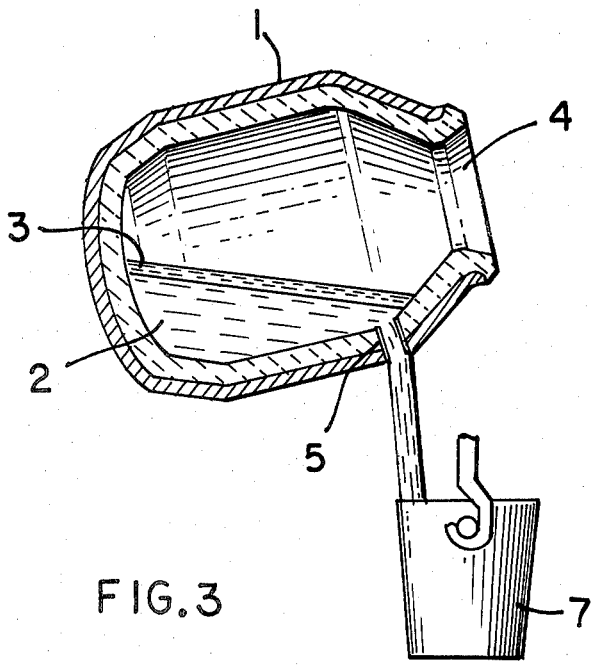
FIG. 3 is a view depicting the furnace tilted at a greater angle and the fact that the device has been substantially deteriorated by the molten steel to allow the steel to flow through the taphole into a ladle or container substantially free of contamination.

The invention or inventions are primarily directed to a device generally designated 6 which, as best illustrated in FIG. 2, is employed for closing the taphole 5 for a period of time sufficient to allow the taphole to move through and below the layer of slag 3 when the furnace is tilted about its trunions (not shown) and so that the molten metal will automatically disintegrate or destroy the device and allow substantially only the metal to flow through the taphole or passage into a ladle 7 or other container and be substantially free of contamination as evidenced in FIG. 3. A lance 8 detachably connectible with the device is utilized to preferably manipulate and insert the device into the outer end of the taphole 5 as shown in FIG. 1. The lance is preferably in the form of an elongated length of pipe which may have a length of between seven (7) and fifteen (15) feet.

Figure 4:
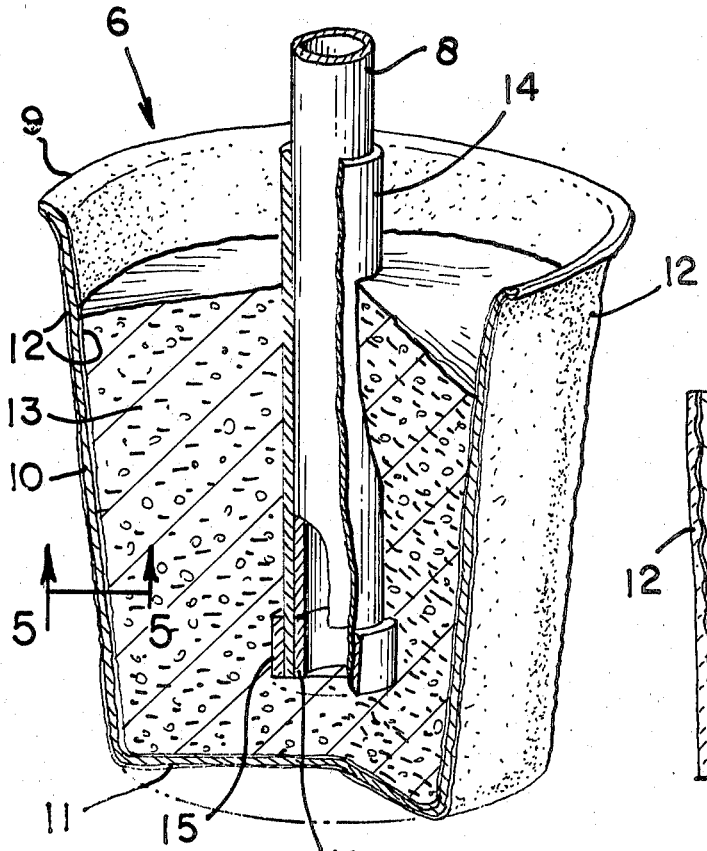
FIG. 4 is an elevational view of the device with portions broken away to illustrate structural details.
Figure 5:
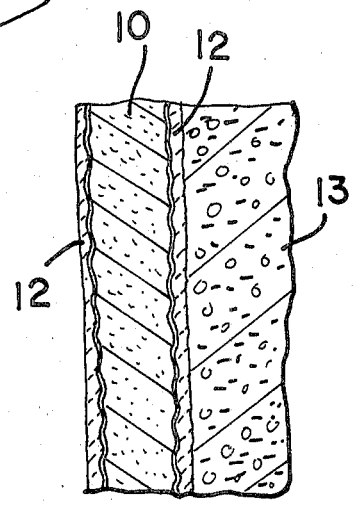
FIG. 5 is an enlarged transverse section taken substantially on line 5—5 of FIG. 4.
Figure 6:
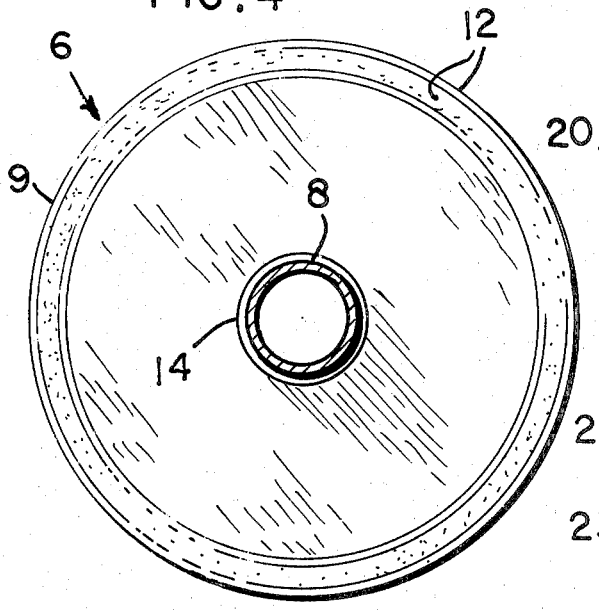
FIG. 6 is a top view of the device depicted in FIG. 4.

The structure of the device 6 as illustrated in FIGS. 4, 5 and 6 will now be described. This device may be designed and constructed in various ways but is preferably in the form of a tapered plug comprising a preformed hollow container, body or cup 9 having a tapered cylindrical wall 10 and a bottom wall 11. This container is preferably constructed of a cellulosic material such as papier-mache and its internal and external surfaces are relatively rough. The container is preferably dipped into a high temperature refractory slurry so that all surfaces of the container are coated with a layer of the refractory 12 which serves to insulate and protect the interior. Obviously, a refractory material may be brushed or sprayed onto the surfaces of the container in lieu of being dipped or immersed in a vessel containing a slurry. The rough internal and external surfaces of the container serve to promote adhesion of the refractory material thereto.

It is believed that the plugs for the majority of tapholes in furnaces and other vessels currently in use be constructed to have a weight range of between five (5) and twenty (20) pounds; a range of lengths of between six (6) inches and two (2) feet; the smaller end with cross-dimensions within a range of two (2) to six (6) inches and the larger cross-dimensions within a range of four (4) to twelve (12) inches. Otherwise expressed, the range of lengths and cross-dimensions of plugs may be modified to accommodate them to the variable dimensions of tapholes and conditions resulting from the repeated use of the latter. It is believed that the range lengths of tapholes is between four (4) and five (5) feet and their range of cross-dimensions between four and one-half ($4\frac{1}{2}$) and nine (9) inches.

In order to impart stability and durability to the plug and facilitate its manipulation into the taphole and after the refractory 12 has preferably dried, a plurality or aggregate of materials, such as paper dust, sawdust, wood fiber, plaster mix, glue and water are mixed into a composite mass 13, which is placed in the container and allowed to dry. Attention is directed to the fact that the container, paper dust, sawdust and wood fiber are of a cellulosic character and therefore combustible or disintegratable when the plug is being disintegrated by the molten metal. The percentages or quantities of these materials and the others named above assist in providing a relatively solid but slightly yieldable or resilient mass, body and/or a device which has proven to be practical and efficient for the use intended.

Figure 7:
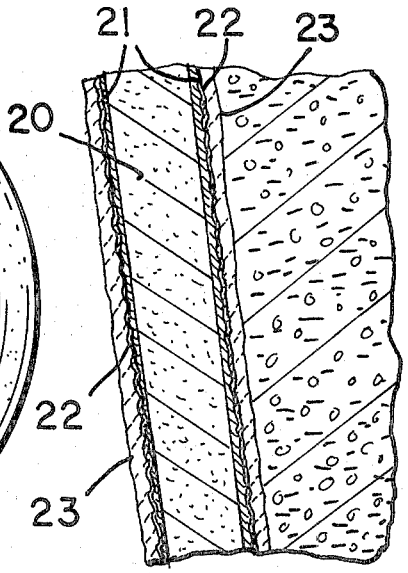
FIG. 7 is an enlarged relatively small partial vertical section of a modified device.

FIG. 7 discloses an enlarged partial section of a modified structure in which the internal and external surfaces of the walls of a container, such as the side wall 20, are relatively smooth and in order to provide for the adherance of a refractory material to the container, such surfaces are preferably treated with a coat or layer of an appropriate adhesive 21 which serves to hold a layer of cheesecloth 22 or equivalent material in place about and in the container. This material more or less provides a rough surface or surfaces affording a base to which a layer or coat of refractory material 23 is applied for protecting and insulating the container which is completely or partially filled with a mass of composite materials of the character described above. A tube 14 is preferably installed by first placing a mound of the mass on the bottom wall 11 of the container, locating a lower end of the tube on the mound and then placing an additional quantity of the mass into the container and about the tube to the level shown so that the upper end of the tube preferably projects or extends above the mass in order to facilitate entry of the lance into the tube. Obviously, the length of the tube may be shorter or longer than shown. This tube provides or assists in providing a socket or receptable for the lance. The lower extremity of the tube 14 is preferably provided with an internal annular ring 14' which constitutes an abutment means or stop for limiting or predetermining the extent that the lance can be inserted into the tube and absorbing pressure from the lance when the plug or device is being forced into a taphole. The lower extremity is also preferably provided with an external ring 15 which serves to reinforce the extremity and thereby assist in preventing expansion or distortion of the tube when the lance is being inserted therein or the device is being forced into the taphole.

In view of the foregoing it will be manifest that either of the devices described above can be readily manipulated by the lance 8 to preferably insert a device into the outer end of the taphole 5 and that when the furnace is tilted the taphole will be moved through and below the level of the layer of slag and this then allows the molten metal to take over and automatically disintegrate or substantially destroy the device or plug and thereby permit substantially only the molten metal to flow through the taphole and into the ladle 7 for any subsequent use desired. The device is of such a character or structure that its substantially original identity or shape or durability is preferably maintained for a period of time sufficient to permit the taphole to move through and below the layer of slag so that the molten metal can then destroy the device. The time frame involved in disintegrating the device is substantially between fifteen (15) and twenty (20) seconds and this frame may obviously be varied by modifying the structural characteristics of the device.

Having thus described my invention or inventions, it is obvious that various modifications or additions to those described may be made in the same without departing from the spirit of the invention and, therefore, I do not wish to be understood as limiting myself to the exact forms, constructions, arrangements, and combinations of the components herein shown and described.

I claim:

1. A device for plugging a taphole in a furnace adapted to contain a mass of molten metal having a layer of slag thereon, said device comprising a generally tapered resilient plug, a substantially centrally disposed elongated socket fixedly secured in said plug for detachably receiving the end of a lance adapted to facilitate manipulation of the device into such a taphole, and a stop located at the inner end of said socket for limiting inward movement of the lance.

2. A device for plugging the outer end of a taphole of a furnace adapted to contain a mass of molten metal having a layer of slag thereon, said device comprising a container of cellulosic material, a substantially solid composite mass of disintegestable materials molded in said container, means embedded in said mass for detachable connection with a lance whereby to manipulate the device into the taphole, and said device when inserted into the taphole serving to retard entry of slag into the taphole for a period of time during which the furnace is being tilted and subsequently allow the metal to automatically disintegrate the device and thereby allow only the metal to flow through the taphole.

3. A device for plugging a taphole in a furnace adapted to contain a mass of molten metal supporting a layer of slag, said device serving to retard entry of the slag into the taphole and comprising a combustible non-metallic preformed container containing a substantially solid molded mass of composite materials the majority of which are combustible, said device being provided with an elongated socket embedded in said mass whereby to facilitate its slidable connection with a lance for manipulating the device into the taphole, and an abutment in the inner end of said socket for limiting inward movement of the lance.

4. The device defined in claim 3, in which at least a major portion of the container is protected by a layer of refractory material, the mass of composite materials comprises paper dust, sawdust, a plaster mix, glue and water, and said socket has an outer extremity extending outwardly from the mass whereby to facilitate the entry of the lance into the socket.

5. A device for plugging the taphole in a vessel adapted to contain a mass of molten metal having a layer of slag thereon, said device comprising a tapered cellulosic container having walls provided with external rough surfaces, a layer of refractory material covering said surfaces, an aggregate of composite materials molded in said container to form a substantially solid mass, and a socket embedded in said mass for detachably accommodating a lance whereby the latter serves to manipulate the device into a taphole, said socket having an inner end which is substantially closed by said mass.

6. The device defined in claim 5, including a layer of cloth adhesively secured to said surfaces of said container under said layer of refractory material.

7. The device defined in claim 5, in which the weight is within a range of between five and twenty pounds.

8. The device defined in claim 5, in which its smaller end cross-dimensions are within a range of between two and six inches, its larger cross-dimensions are within a range of four to twelve inches, and its length within a range of between six inches and two feet.

9. A plug which is shaped for insertion into the end of a taphole in a vessel adapted to contain a mass of molten material having a layer of slag thereon for substantially retarding the flow of any slag into the taphole, said plug comprising a cellulosic container having a bottom wall and a tapered cylindrical side wall, a mass of solid materials molded in said container, a tube embedded in said mass affording a detachable connection with a lance whereby the latter may be utilized to manipulate the plug into such a taphole, and means in said tube inset from said bottom wall for limiting inward movement of the lance.

10. The plug defined in claim 9, including means in said mass surrounding an inner end of said tube for reenforcing it.

11. The plug defined in claim 9, in which an inner end of the tube is located entirely within the confines of the mass, including means surrounding said end for reenforcing it, and means in said inner end for limiting inward movement of the lance.

12. A disintegratable plug for use in plugging the taphole in a tiltable furnace adapted to contain a mass of molten metal having a layer of slag thereon, said plug serving to substantially retard the escape of the slag through the taphole when the furnace is tilted but will be disintegrated by the molten metal to allow substantially only the latter to flow through the taphole and comprising a non-metallic container having a bottom wall and a tapered cylindrical wall, layers of ceramic material protecting the inner and outer surfaces of said walls, a composite substantially solid mass of material molded in said container, an elongated socket embedded in said mass for slidably receiving a lance, and means in the inner end of said socket for limiting insertion of the lance into the socket.

13. A method of constructing a device for plugging a taphole in a vessel adapted to contain a mass of molten metal having a layer of slag thereon which comprises: providing a tapered container having a bottom wall and a tapered cylindrical wall, positioning a tube axially in said container, and then substantially filling said container with a substantially solid mass of material about said tube whereby the latter may accommodate a lance and the inner end of the tube is inset from said bottom wall and substantially closed by the mass.

14. A method of constructing a device for plugging a taphole in a vessel adapted to contain a mass of molten metal having a layer of slag thereon which comprises: providing a tapered container having a bottom wall and a tapered cylindrical wall and having external rough surfaces, applying a layer of refractory material to said surfaces, positioning a tube substantially axially in said container, and then substantially filling said container with an aggregate of materials to form a substantially solid mass about said tube whereby the latter may accommodate a lance and an inner end of said tube is inset from said bottom wall and substantially closed by said mass.

* * * * *